United States Patent [19]

Chatfield et al.

[11] 4,251,294

[45] Feb. 17, 1981

[54] METHOD FOR PRODUCING FULLY-PROCESSED LOW-CARBON ELECTRICAL STEEL

[75] Inventors: David A. Chatfield, Coraopolis, Pa.; Joseph F. Rzepka, Weirton, W. Va.; Alan C. Preble, Bradford Woods, Pa.

[73] Assignee: National Steel Corporation, Pittsburgh, Pa.

[21] Appl. No.: 935,972

[22] Filed: Aug. 22, 1978

[51] Int. Cl.[3] ..... H01F 1/00

[52] U.S. Cl. ..... 148/120; 148/12 A; 148/12 F

[58] Field of Search ..... 148/12 A, 12 F, 120, 148/121

[56] References Cited

U.S. PATENT DOCUMENTS

| | | | |
|---|---|---|---|
| 2,672,429 | 3/1954 | Malloy | 148/12 A |
| 3,392,063 | 7/1968 | Kohler | 148/12 A |
| 3,819,426 | 6/1974 | Decaro et al. | 148/120 |
| 3,892,605 | 7/1975 | Thornburg | 148/120 |
| 4,003,769 | 1/1977 | Davis | 148/121 |

*Primary Examiner*—L. Dewayne Rutledge
*Assistant Examiner*—John P. Sheehan
*Attorney, Agent, or Firm*—Shanley, O'Neil and Baker

[57] ABSTRACT

A method for producing fully processed, non-silicon containing, low-carbon electrical steel without post-anneal deformation by continuously annealing a steel strip having a carbon content less than 0.02% at a temperature within the range of 1350° F. to 1550° F.

2 Claims, No Drawings

METHOD FOR PRODUCING FULLY-PROCESSED LOW-CARBON ELECTRICAL STEEL

BACKGROUND OF THE INVENTION

This invention relates to the production of low-carbon steel sheet for electrical applications and, more particularly to an improved method for producing fully-processed, low-carbon, non-silicon bearing steel sheet having magnetic properties which are especially suited to its use in the magnetic cores of electrical equipment.

The development of silicon containing steels around the first part of this century has made possible the production of efficient and more powerful electrical equipment, a factor which played an important role in the rapid growth of the electrical-power industry. Such steels are characterized by excellent magnetic properties, i.e., high magnetic permeability, high electrical resistance and low hysteresis losses, but they are relatively expensive because of the exacting parameters required in their production.

This high cost factor may be acceptable where exceptional magnetic properties are required, such as, for example, in the case of large transformers or highest efficiency motors or generators and the like, but there are many instances where superior magnetic properties are not required for efficient operation of electrical equipment, such as, for example, in the case of consumer appliances and similar small electrical equipment. In those instances the high cost of the silicon-containing steel could not be justified.

As more and more such small electrical equipment was developed for the marketplace, the demand for a less costly steel became greater and this demand was met by the production of non-silicon bearing electrical steels. Such steels are commonly produced either from a low-carbon steel heat or by a decarburization procedure wherein plain carbon steel strip is subjected to annealing, e.g., open coil annealing, followed by a critical straining to obtain elongation within certain limits. The steel is usually sold in semi-processed condition so that it must subsequently be annealed by the customer, usually after stamping or similar article production procedures. The electrical steel produced by such methods was clearly less expensive than the silicon-containing steel, but it was still more expensive than desired for many applications and thus there has been a continuing need for electrical steel which would not only have the desired magnetic properties required of smaller electrical equipment but also would be fully-processed and satisfy the cost-factor requirements of present day economics.

This continuing need for such a low-cost steel has now been met in the present invention which will be more fully described below.

SUMMARY OF THE INVENTION

The electrical steel produced according to this invention is fully processed, i.e., it does not require a subsequent processing such as temper rolling and/or annealing in order to achieve its desired magnetic properties. The steel is of a low carbon, i.e., less than 0.02% by weight, non-silicon composition and is characterized by specific magnetic properties. That is to say, a sheet having a thickness of 0.025 inches will exhibit a core loss of less than 6 watts/lb. at 60 cps and 15 kilogauss and a permeability greater than 1,000 gausses/oersted at 60 cps and 15 kilogauss.

The steel sheet is produced by conventional hot and cold rolling techniques, but in order to achieve the desired properties it must be continuously annealed, preferably at a temperature within the range 1350° to 1550° F., and it must not be mechanically deformed after annealing in any way.

DESCRIPTION OF THE PREFERRED EMBODIMENTS

The starting steel utilized in this invention may have a non-silicon bearing composition substantially the same as commercially available low-carbon sheet steel, although it must have a carbon content less than about 0.02% by weight. When initially produced, for example, in a basic oxygen furnace or open hearth the starting steel may contain from about 0.03 to about 0.07% carbon, preferably from about 0.045 to 0.06% carbon, but it will subsequently be subjected to vacuum degassing to reduce the percentage of carbon below the desired 0.02% by weight, i.e. below 0.02% to a level higher than 0.002% by weight. Typical of the non-silicon, low-carbon steel which may be utilized in this invention is a steel composition having a post-degassing manganese content of from about 0.25 to about 1% by weight, a post-degassing phosphorus content of from about 0.03% to about 0.15%, and a pre-degassing analysis within the following range: from 0.03 to 0.07% carbon, from about 300 p.p.m. to about 800 p.p.m. oxygen, and the balance being iron and residual elements.

Any number of degassing methods are suitable for reduction of the carbon content but preferably the degassing will be carried out by one of the recirculating methods, for example D-H or R-H methods which are described at page 598 in the publication entitled "The Making, Shaping and Treating of Steel" (9th Ed.), published by the United States Steel Corporation.

As used in this invention, the term non-silicon steel is defined as an electrical steel which has no added silicon and no more than 0.03% silicon, preferably about 0.01% silicon, as a residual material.

After degassing, the steel is formed into slabs by conventional slabbing procedures, such as, for example, by a continuous casting process or by casting into ingots and slabbing in a blooming mill.

Once formed, the slabs are hot rolled to sheet having a nominal gage of about 0.1 inch. The temperature of the material leaving the finishing train will, for example, be within a range between about 1550° F. to about 1650° F., preferably from about 1575° F. to about 1625° F. The hot rolled material is then cooled by conventional means, such as water sprays, so that it may be coiled at a temperature, for example, ranging from about 1250° F. to about 1400° F.

After cooling, the steel is suitably pickled to remove mill scale and can then be cold rolled to finished gage, e.g., by passage through a tandem mill, and continuously annealed at a temperature greater than 1350° F., preferably 1350° F. to 1550° F. and most preferably 1400° F. to 1500° F. The finished sheet will generally have a thickness within the range of between about 0.018 inch to about 0.028 inch. The cooling rate following the continuous anneal will be typical of conventional continuous annealing processes but the tension on the strip as it goes through the annealing process must be sufficient enough to flatten the strip in the furnace.

It is important to note that, in order to achieve the magnetic properties desired in this invention, a continuous annealing must occur at a temperature in excess of 1350° F. and after the annealing has been accomplished there must be no mechanical deformation of the sheet. The annealed product resulting will be fully processed and will exhibit desirable electrical properties, i.e., a product having a nominal gage of 0.025 inch will exhibit a core loss of less than about 6 watts/lb. at 60 cps and 15 kilogauss and a permeability greater than 1,000 gausses-/oersted at 60 cps and 15 kilogauss.

The following examples will further illustrate the invention.

EXAMPLE I

Steel from a basic oxygen furnace having phosphorus and manganese added to it in the form of ferromanganese and ferrophosphorus, such addition taking place in the ladle, contains 0.05% by weight carbon and 500 p.p.m. by weight oxygen and sufficient manganese and phosphorus to provide 0.45% manganese and 0.05% phosphorus in the finished product. The steel in molten condition in the ladle is degassed utilizing an R-H degassing process to reduce the carbon content to 0.01% and the oxygen content to 200 p.p.m. After degassing, the steel is cast into ingots and slabbed in a blooming mill. The slab is hot rolled with a temperature leaving the finishing train of 1600° F. and coiled at a temperature of 1325° F. The coiled material is pickled utilizing a four tank system with the tanks containing aqueous sulfuric acid solution at concentrations ranging from 10 to 20% by volume. The pickled material is cold rolled to a nominal gage of 0.025 inches. The material so produced is continuously annealed at 1400° F. for 2 minutes in a nondecarburizing atmosphere.

The annealed material has an average core loss of 5.85 watts/lb. and a permeability of 1560 gausses/oersted.

EXAMPLE II

This example illustrates the comparatively inferior magnetic properties which result when electrical steel produced essentially according to the method of Example I is mechanically deformed, i.e., temper rolled, after the continuous anneal. All values listed below relate to a 0.025 inch thick sheet.

| Annealing Treatment | Average Core Loss Watts/lb. | Average Peak Permeability Gausses/Oersted |
|---|---|---|
| Continuously Annealed | 6.0 | 1375 |
| Continuously Annealed plus 0.25% Rolling Reduction | 6.5 | 700 |

Unless otherwise indicated, all amounts or proportions used in the above examples will be by weight.

This invention may be embodied in specific forms other than those described without departing from the spirit or the essential characteristics of the invention. Therefore, the present embodiments are to be considered in all respects as illustrative and not restrictive, the scope of the invention being indicated by the appended claims rather than by the foregoing description. Thus, all changes which come within the meaning and range of equivalency of the claims are intended to be embraced within those claims.

We claim:

1. A method for producing fully processed non-silicon, low-carbon electrical steel, said method being carried out without post-anneal mechanical deformation comprising (a) providing steel in molten condition consisting essentially of from about 0.03 to about 0.07% carbon, from about 300 p.p.m. to about 800 p.p.m. oxygen, from about 0.03% to about 0.15% phosphorus as measured subsequent to step (b), from about 0.25% to about 1% manganese as measured subsequent to step (b), and the balance being iron,
(b) degassing said steel to reduce the percentage of carbon below 0.02% to a level higher than 0.002%.
(c) forming the degassed material into slabs,
(d) hot rolling the slabs to strip having an intermediate gage,
(e) coiling the strip,
(f) pickling,
(g) cold rolling, and
(h) as a final step, annealing the strip continuously at a temperature within the range 1350° F. to 1550° F. while maintaining sufficient tension on the strip being annealed to produce a flat product suitably for lamination.

2. A method as defined in claim 1 wherein said as-rolled steel sheet has a 0.025 inch thickness and after continuously annealing is characterized by a core loss of less than about 6 watts per pound and a permeability exceeding 1000 gausses per oersted.

* * * * *